US012478146B2

(12) United States Patent
Miyazaki

(10) Patent No.: US 12,478,146 B2
(45) Date of Patent: Nov. 25, 2025

(54) SLIDER

(71) Applicant: YKK CORPORATION, Tokyo (JP)

(72) Inventor: Yohei Miyazaki, Toyama-ken (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 18/748,111

(22) Filed: Jun. 20, 2024

(65) Prior Publication Data

US 2025/0017329 A1 Jan. 16, 2025

(30) Foreign Application Priority Data

Jul. 10, 2023 (CN) ..... 202310836963.4

(51) Int. Cl.
*A44B 19/30* (2006.01)

(52) U.S. Cl.
CPC ..... *A44B 19/306* (2013.01)

(58) Field of Classification Search
CPC ..... A44B 19/306; A44B 19/26; A44B 19/262; A44B 19/303
See application file for complete search history.

(56) References Cited

U.S. PATENT DOCUMENTS 2,277,503 A 3/1942 Pickens
2,277,978 A 3/1942 Hoflich
3,919,746 A * 11/1975 Fukuroi ..... A44B 19/306 24/421
4,074,399 A * 2/1978 Kedzierski ..... A44B 19/306 24/425
6,637,078 B2 * 10/2003 Nagata ..... A44B 19/306 24/429
6,769,156 B1 * 8/2004 Chen ..... A44B 19/306 24/429
2002/0152591 A1 * 10/2002 Nagata ..... A44B 19/306 24/421
2009/0288276 A1 * 11/2009 Dhanapal ..... A44B 19/306 24/421
2017/0290394 A1 * 10/2017 Hamada ..... A44B 19/308
2022/0125165 A1 * 4/2022 Peng ..... A44B 19/308

FOREIGN PATENT DOCUMENTS

CN 104921420 9/2015
CN 211065274 7/2020
CN 212394083 1/2021
(Continued)

*Primary Examiner* — David M Upchurch
(74) *Attorney, Agent, or Firm* — JCIPRNET

(57) ABSTRACT

A slider operable in a simple operation manner and capable of reducing an overall volume is provided. The slider includes: a slider body; a claw member positioned on the slider body and having a lock pin portion extending to an interior of the slider body to establish a locked state; an operation piece positioned on the slider body and connected to the claw member. The operation piece has first and second shaft portions that are separately positioned. The operation piece is rotatably positioned on the slider through the first shaft portion and connected to the claw member through the second shaft portion. Upon pressing the operation piece and enabling one side of the operation piece to rotate toward the slider with the first shaft portion as an axis center, the second shaft portion lifts the claw member to release the locked state in the interior of the slider body.

10 Claims, 6 Drawing Sheets

(56) References Cited

FOREIGN PATENT DOCUMENTS

| | | |
|---|---|---|
| CN | 215347322 | 12/2021 |
| CN | 113907493 | 1/2022 |
| FR | 2425209 | 12/1979 |
| JP | 3393579 | 4/2003 |
| JP | 4109618 | 7/2008 |
| JP | 4562769 | 10/2010 |

* cited by examiner

SLIDER

CROSS-REFERENCE TO RELATED APPLICATION

This application claims the priority benefit of Chinese patent application no. 202310836963.4, filed on Jul. 10, 2023. The entity of the above-mentioned patent application is hereby incorporated by reference herein and made a part of this specification.

BACKGROUND

Technical Field

The disclosure relates to a slide fastener and more particularly relates to a slider.

Related Art

A common slide fastener usually includes a pair of fastener chains composed of strip-like fastener tapes, a plurality of elements arranged on the fastener tapes, and a slider installed on the fastener chains to disengage or engage the elements through a sliding action. A tab pull may be further positioned on the slider as needed. In addition, a lock pin portion can be positioned on a slider body. Thus, when the lock pin portion extends to the interior of the slider body, the lock pin portion is inserted into the fastener chains passing through the space between upper and lower wing plates of the slider body to lock the fastener tapes or the elements, thereby preventing the slider from sliding unexpectedly. Correspondingly, when the lock pin portion is connected to the tab pull, operating (e.g., pulling) the tab pull results in the removal of the lock pin portion from the fastener chains to release the lock on the fastener tapes or the elements, thereby allowing the slider to further slide to disengage or engage the elements. In the related art, depending on where the slide fastener is applied (such as attaching a hood to a garment), sometimes the size of the tab pull is reduced to prevent interference by the tab pull with the object where the slide fastener is applied (e.g., interference caused by a swinging motion of the tab pull or the increase in the overall volume). However, it is challenging to release the locked state of the lock pin portion solely through a pulling operation or other actions when using a short tab pull. Consequently, for sliders used in objects where interference from the tab pull is undesirable, there is a need to enhance the method of releasing the lock pin portion.

RELATED PATENT LITERATURE

[Patent Document 1] French Patent Application Laid-Open No. FR2425209A1

[Patent Document 2] U.S. Pat. No. 2,277,978

SUMMARY

The disclosure provides a slider that is operable in a simple operation manner and capable of reducing an overall volume.

An embodiment of the disclosure provides a slider including: a slider body; a claw member positioned on the slider body and having a lock pin portion extending to an interior of the slider body to establish a locked state; an operation piece positioned on the slider body and connected to the claw member, where the operation piece has a first shaft portion and a second shaft portion which are separately positioned, the operation piece is rotatably positioned on the slider body through the first shaft portion and is connected to the claw member through the second shaft portion, and when the operation piece is pressed to enable one side of the operation piece to rotate toward the slider body with the first shaft portion as an axis center, the operation piece lifts the claw member through the second shaft portion to release the locked state of the lock pin portion in the interior of the slider body.

According to an embodiment of the disclosure, the operation piece has a front end portion corresponding to a front end of the slider body and a rear end portion corresponding to a rear end of the slider body, the front end portion is equipped with an operation portion configured to release the locked state, the second shaft portion is positioned on the rear end portion, and the first shaft portion is positioned at a location closer to the front end portion than the second shaft portion.

According to an embodiment of the disclosure, the front end portion of the operation piece is equipped with a finger gripping portion.

According to an embodiment of the disclosure, the operation piece has a protruding portion located between the front end portion and the rear end portion and protruding upwards or downwards, and the first shaft portion is positioned at the protruding portion.

According to an embodiment of the disclosure, the operation portion of the operation piece is shaped as a rectangle in a width direction of the slider body.

According to an embodiment of the disclosure, the claw member has a fixed end portion extending to a front end of the slider body, and the fixed end portion is secured at a location lower than an upper wing plate of the slider body.

According to an embodiment of the disclosure, a center of the operation piece is equipped with an insertion portion configured to be inserted by the claw member.

According to an embodiment of the disclosure, the slider body has a limiting portion configured to restrict the first shaft portion of the operation piece, and the limiting portion is located closer to a front end of the slider body than the first shaft portion.

According to an embodiment of the disclosure, in the locked state, a first distance in a height direction of the slider body exists between an end of the lock pin portion extending to the interior of the slider body and an inner surface of an upper wing plate of the slider body, a second distance in the height direction exists between an axis center of the first shaft portion and an axis center of the second shaft portion, and the second distance is less than the first distance.

According to an embodiment of the disclosure, the claw member is a flexible leaf spring.

Based on the above, in the slider provided in one or more embodiments of the disclosure, the claw member has the lock pin portion that extends to the interior of the slider body to establish the locked state. The operation piece has the first and second shaft portions that are separately positioned. The operation piece is rotatably positioned on the slider body through the first shaft portion and connected to the claw member through the second shaft portion. When the operation piece is pressed to enable one side of the operation piece to rotate toward the slider body with the first shaft portion as the axis center, the operation piece lifts the claw member through the second shaft portion to release the locked state of the lock pin portion in the interior of the slider body. As such, the slider can release the locked state of the lock pin portion through simple operation of the operation piece (e.g., gently pressing the operation piece) based on the principle of leverage. Moreover, there is no need to position any tab pull for a user to pull to release the lock pin portion, and the first and second shaft portions are separately positioned, which can reduce the overall volume of the slider. Accordingly, the slider provided in one or more embodiments of the disclosure is operable in a simple operation manner and capable of reducing the overall volume.

Other features and advantages provided in this invention will be further understood from the embodiments hereinafter with reference to the accompanying drawings.

DESCRIPTION OF THE EMBODIMENTS

Figure 1:
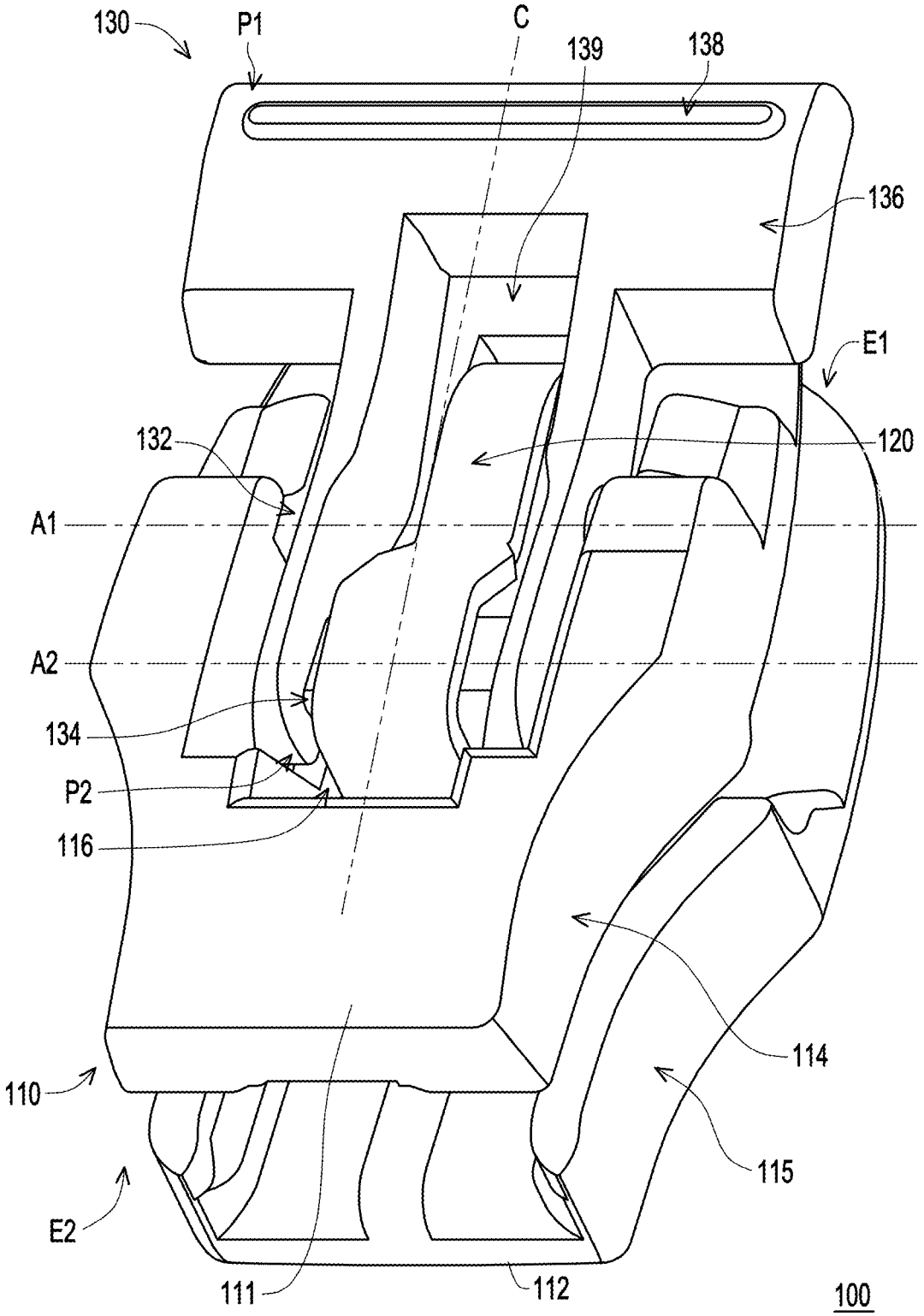
FIG. 1 is a schematic three-dimensional view of a slider according to an embodiment of the disclosure.
Figure 2:
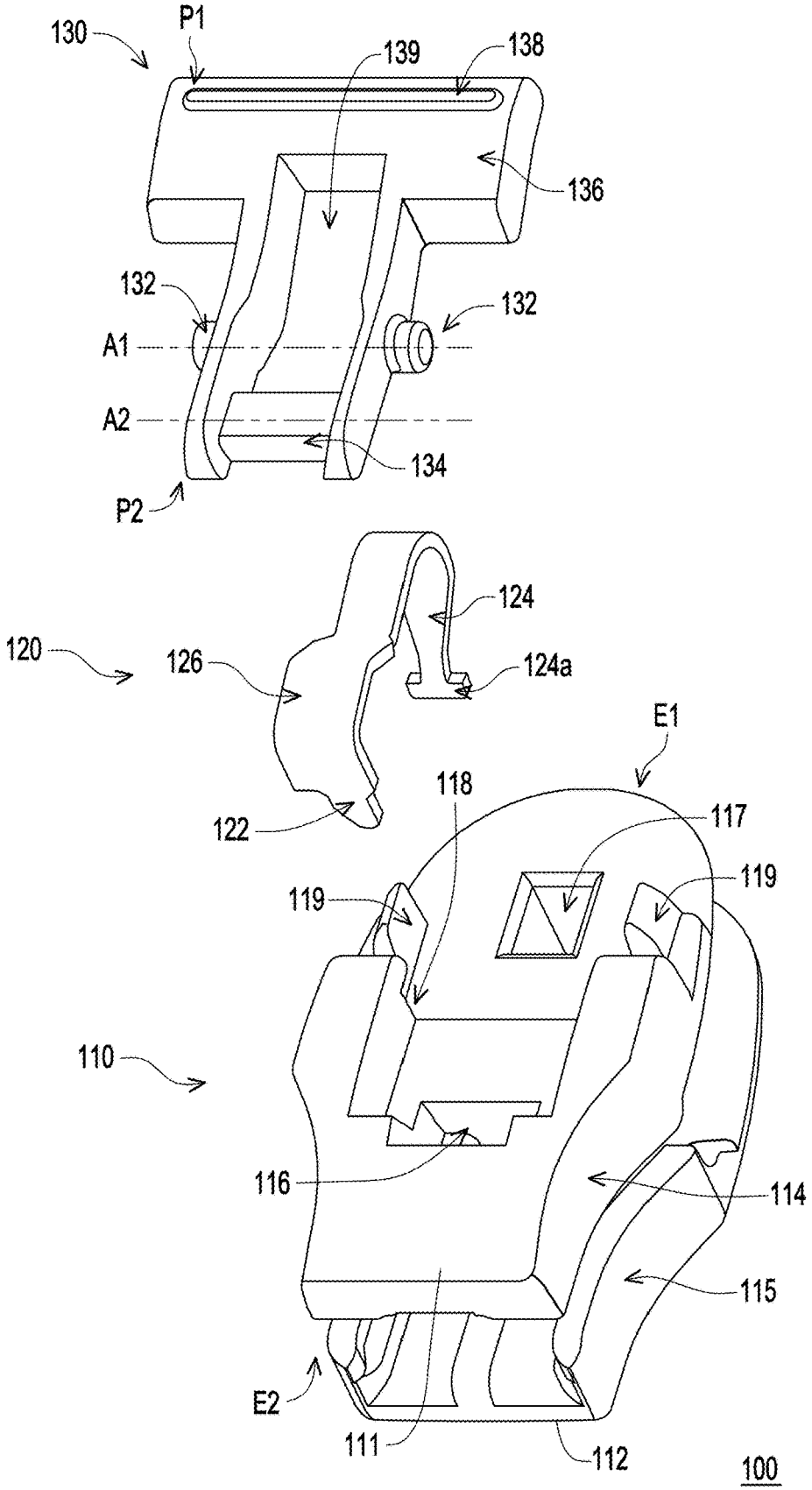
FIG. 2 is a schematic exploded view of the slider shown in FIG. 1.
Figure 3A:
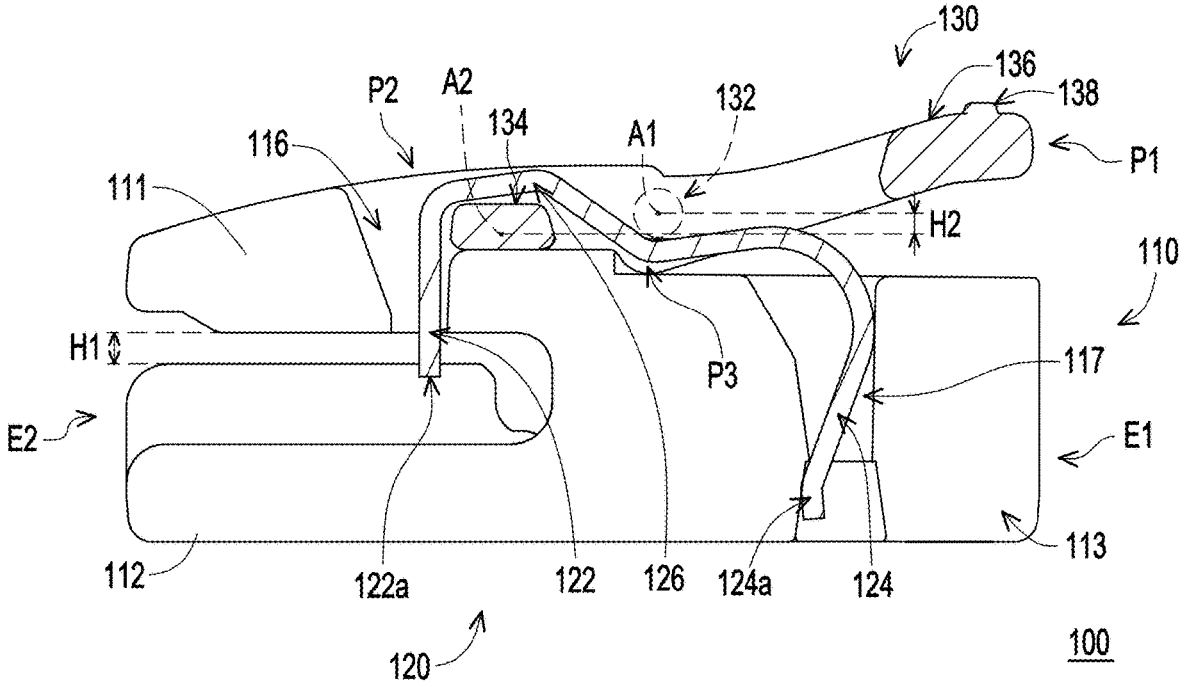
FIG. 3A and FIG. 3B are schematic side views of the slider shown in FIG. 1 in a locked state and a released state, respectively.
Figure 3B:
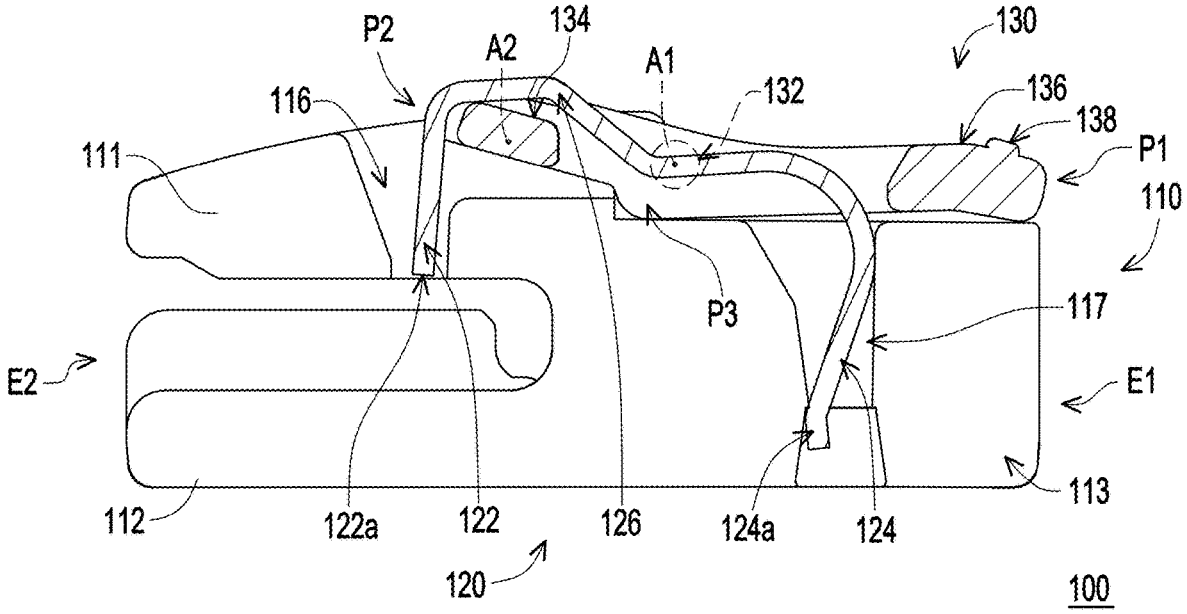
Figure 4:
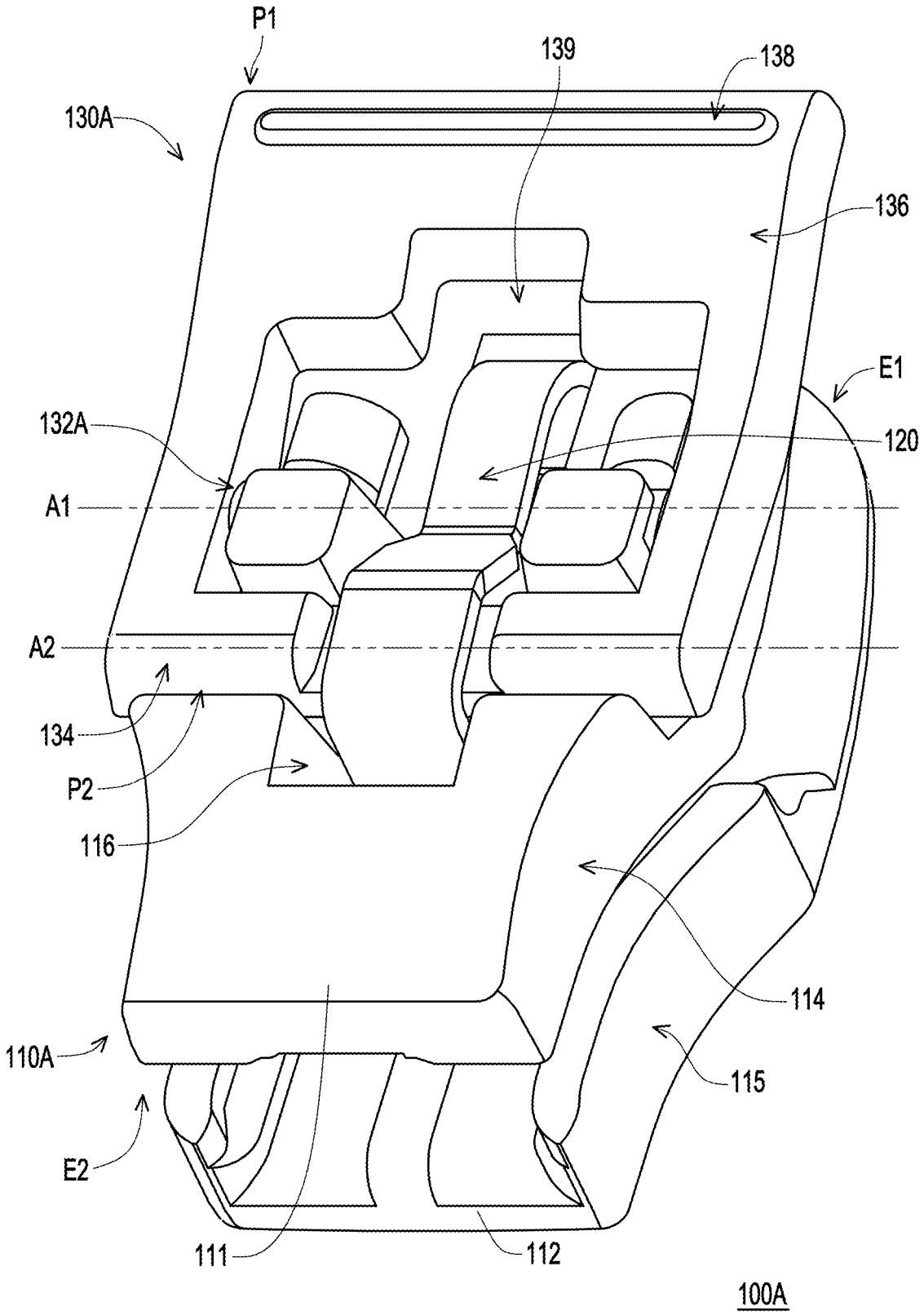
FIG. 4 is a schematic three-dimensional view of the slider shown in FIG. 1 in another variant embodiment.
Figure 5:
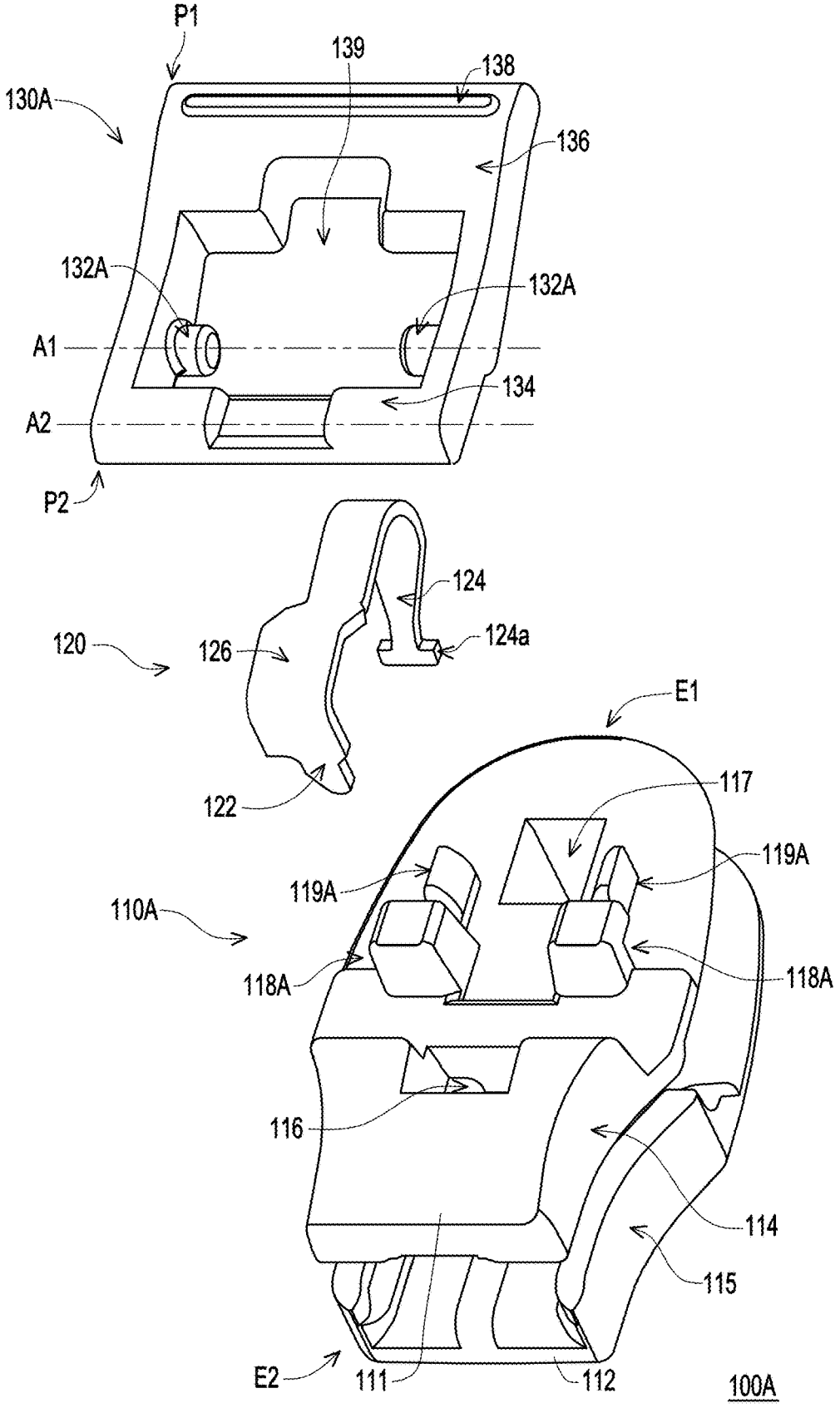
FIG. 5 is a schematic exploded view of the slider shown in FIG. 4.
Figure 6:
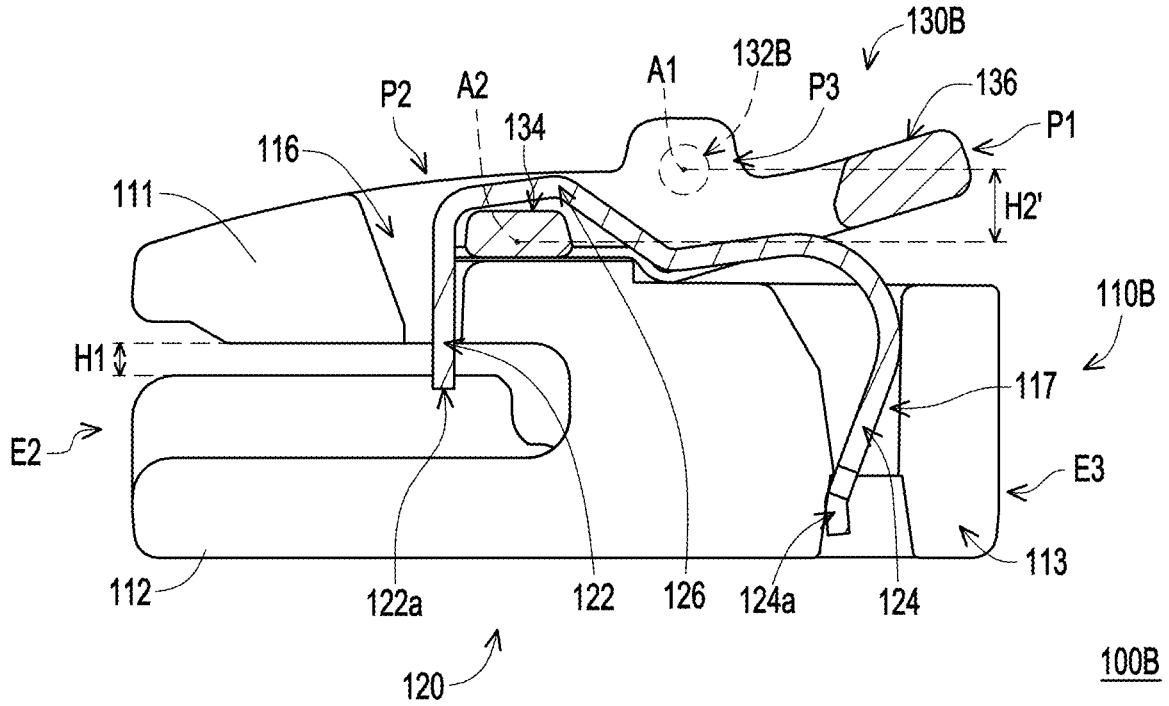
FIG. 6 is a schematic side view of the slider shown in FIG. 1 in yet another variant embodiment.

FIG. 1 is a schematic three-dimensional view of a slider according to an embodiment of the disclosure; FIG. 2 is a schematic exploded view of the slider shown in FIG. 1; FIG. 3A and FIG. 3B are schematic side views of the slider shown in FIG. 1 in a locked state and a released state, respectively; FIG. 4 is a schematic three-dimensional view of the slider shown in FIG. 1 in another variant embodiment; FIG. 5 is a schematic exploded view of the slider shown in FIG. 4; FIG. 6 is a schematic side view of the slider shown in FIG. 1 in yet another variant embodiment. The specific structure and the operation manner of a slider 100 provided in an embodiment of the disclosure will be explained with reference to FIG. 1 to FIG. 3B, and the specific structure of sliders 100A and 100B provided in other variant embodiments will be explained with reference to FIG. 4 to FIG. 6, which should however not be construed as a limitation in the disclosure and may be adjusted according to actual needs.

With reference to FIG. 1 to FIG. 3B, in this embodiment, the slider 100 includes a slider body 110, a claw member 120, and an operation piece 130. The claw member 120 is positioned on the slider body 110 and has a lock pin portion 122 that extends to the interior of the slider body 110 to establish a locked state. The operation piece 130 is positioned on the slider body 110 and connected to the claw member 120. Here, the operation piece 130 has a first shaft portion 132 and a second shaft portion 134 that are separately positioned. The operation piece 130 is rotatably positioned on the slider body 110 through the first shaft portion 132 and connected to the claw member 120 through the second shaft portion 134. As such, when the operation piece 130 is pressed to enable one side of the operation piece 130 to rotate toward the slider body 110 with the first shaft portion 132 as an axis center, the operation piece 130 lifts the claw member 120 through the second shaft portion 134 to release the locked state of the lock pin portion 122 in the interior of the slider body 110. Thereby, the slider 100 can release the locked state of the lock pin portion 122 through simple operation of the operation piece (e.g., gently pressing the operation piece 130) based on the principle of leverage. Moreover, there is no need to position any tab pull for a user to pull to release the lock pin portion 122, and the first shaft portion 132 and the second shaft portion 134 are separately positioned, which can reduce the overall volume of the slider 100. Therefore, the slider 100 is operable in a simple operation manner and capable of reducing the overall volume.

Specifically, in this embodiment, as shown in FIG. 1 and FIG. 2, the slider body 110 includes an upper wing plate 111 and a lower wing plate 112 positioned opposite to each other, a connection column 113 connecting the upper wing plate 111 and the lower wing plate 112 at a front end E1 of the slider body 110, and a side edge 114 of the upper wing plate 111 and a side edge 115 of the lower wing plate 112 which are located at a rear end E2 of the slider body 110 and respectively protrude in opposite directions. As such, the slider 100 is adapted to be installed on fastener chains (not shown), where elements of the fastener chains pass through the space between the upper wing plate 111 and the lower wing plate 112 of the slider body 110, and fastener tapes of the fastener chains pass through gaps between the side edge 114 of the upper wing plate 111 and the side edge 115 of the lower wing plate 112, thereby enabling the slider 100 to slide relative to the fastener chains and disengage or engage the elements through the connection column 113. The slider body 110, for instance, is formed by die casting of a metal material, while the specific structure and the material of the slider body 110 should not be construed as limitations in the disclosure and can be adjusted according to actual needs.

Moreover, in this embodiment, as shown in FIG. 2 and FIG. 3A, the claw member 120 is (but not limited to), for instance, a flexible leaf spring. Here, the lock pin portion 122 of the claw member 120 corresponds to the rear end E2 of the slider body 110. Correspondingly, a lock through hole 116 is positioned at the rear end E2 of the slider body 110. The lock pin portion 122 of the claw member 120 extends to the interior of the slider body 110 through the lock through hole 116 to establish a locked state; for instance, the lock pin portion 122 extends into the space between the upper wing plate 111 and the lower wing plate 112 (as shown in FIG. 3A). Specifically, an end 122*a* of the lock pin portion 122 extending to the interior of the slider body 110 extends further downward than an inner surface of the upper wing plate 111 of the slider body 110, so that the end 122*a* of the lock pin portion 122 is located in the space between the upper wing plate 111 and the lower wing plate 112, thereby establishing the above-mentioned locked state. As such, when the slider 100 is installed on fastener chains (not shown), the lock pin portion 122 extending to the interior of the slider body 110 can be inserted to the fastener chains between the upper wing plate 111 and the lower wing plate 112 (e.g., inserted into gaps between the elements or inserted onto the fastener tapes) to establish the locked state. As such, the slider 100 in the locked state cannot easily slide relative to the fastener chains, thereby avoiding unexpected operations.

Furthermore, in this embodiment, as shown in FIG. 2 and FIG. 3A, the claw member 120 has a fixed end portion 124 extending to the front end E1 of the slider body 110. Correspondingly, a fixed through hole 117 is positioned at the front end E1 of the slider body 110. The fixed end portion 124 of the claw member 120 passes through the fixed through hole 117 and is secured to an inner wall of the fixed through hole 117 through fixed protrusion portions 124*a* protruding toward two opposite sides (as shown in FIG. 2).

As such, the fixed end portion 124 of the claw member 120 is a fixed end, and the lock pin portion 122 is a free end, so that the claw member 120 can move the lock pin portion 122 relative to the slider body 110 to release the locked state (i.e., move the lock pin portion 122 from the space between the upper wing plate 111 and the lower wing plate 112) through the operation of the operation piece 130 (as explained hereinafter). In an embodiment of the disclosure, the fixed end portion 124 is secured at a location lower than the upper wing plate 111 of the slider body 110 (e.g., secured at a lower end portion of the fixed through hole 117). Thereby, the fixed end portion 124 can be securely fixed to the slider body 110 and is unlikely to be disengaged from the fixed through hole 117 of the slider body 110 due to the movement of the lock pin portion 122. The specific structure of the claw member 120 and the position where the claw member 120 is installed relative to the slider body 110 should however not be construed as limitations in the disclosure and can be adjusted according to actual needs.

Besides, in this embodiment, as shown in FIG. 2 and FIG. 3A, the claw member 120 has a hanging portion 126 located between the lock pin portion 122 and the fixed end portion 124, and the hanging portion 126 is bent more upward than the lock pin portion 122 and the fixed end portion 124. The hanging portion 126 of the claw member 120 is hung on the second shaft portion 134 and enables the operation piece 130 to connect the claw member 120 through the second shaft portion 134. The fixed end portion 124 extends downward relative to the hanging portion 126 and passes through the fixed through hole 117 and is secured in the slider body 110, while the lock pin portion 122 extends downward relative to the hanging portion 126 and passes through the lock through hole 116 and extends to the interior of the slider body 110, so that the lock pin portion 122 and the fixed end portion 124 are positioned closer to the lower side than the second shaft portion 134. As such, when the operation piece 130 lifts the hanging portion 126 of the claw member 120 through the second shaft portion 134, the lock pin portion 122 of the claw member 120 moves upward relative to the slider body 110 and thus moves out from the interior of the slider body 110 to release the locked state. However, in other embodiments not shown in the drawings, the claw member 120 can penetrate the second shaft portion 134 (for instance, a slot is positioned in the second shaft portion 134), or a limiting structure is positioned at a higher portion of the operation piece 130 than the second shaft portion 134 to limit top and bottom positions of the claw member 120, thereby ensuring the claw member 120 to be connected to the second shaft portion 134 more reliably and easier to lift. The connection manner (the lifting manner) of the claw member 120 and the second shaft portion 134 of the operation piece 130 should not be construed as a limitation in the disclosure and can be adjusted according to actual needs.

Additionally, in this embodiment, as shown in FIG. 2 and FIG. 3A, the operation piece 130 is, for instance, formed by die-casting a metal material or composed of a resin material (which should not be construed as limitations). The operation piece 130 is installed on an upper surface of the upper wing plate 111 of the slider body 110, so that the operation piece 130 can be easily operated from an appearance side of the slider 100 (i.e., one side corresponding to the upper wing plate 111). Here, the operation piece 130 has a front end portion P1 corresponding to the front end E1 of the slider body 110 and a rear end portion P2 corresponding to the rear end E2 of the slider body 110 and is shaped as a thin sheet. An operation portion 136 configured to release the locked state is positioned at the front end portion P1 of the operation piece 130. The second shaft portion 134 is positioned on the rear end portion P2, and the first shaft portion 132 is located closer to the front end portion P1 than the second shaft portion 134 (that is, the first shaft portion 132 is positioned between the operation portion 136 and the second shaft portion 134). In an embodiment of the disclosure, the operation portion 136 of the operation piece 130 is shaped as a rectangle in a width direction of the slider body 110, and the front end portion P1 of the operation piece 130 is equipped with a finger gripping portion 138 (i.e., corresponding to the operation portion 136), which allows easier operation on the operation portion 136 of the operation piece 130.

Through the above configurations, in this embodiment, as shown in FIG. 3A and FIG. 3B, one side of the operation piece 130 (e.g., the front end portion P1 equipped with the operation portion 136) can rotate relative to the slider body 110 (e.g., toward the slider body 110) with the first shaft portion 132 as an axis center, thereby causing the rear end portion P2 with the second shaft portion 134 to rotate in an opposite direction (e.g., away from the slider body 110) based on the principle of leverage. That is, when the operation portion 136 positioned at the front end portion P1 of the operation piece 130 is being operated (e.g., placing a finger on the finger gripping portion 138 and pressing the rectangular operation portion 136), the operation portion 136 of the operation piece 130, serving as a force receiving end, rotates toward the slider body 110 with the first shaft portion 132 as the axis center, while the second shaft portion 134 moves away from the slider body 110. As a result, the second shaft portion 134 can lift the claw member 120 in a direction away from the slider body 110 (i.e., in an upward direction), causing the lock pin portion 122 to move out from the interior of the slider body 110 and thereby releasing the locked state of the lock pin portion 122 in the interior of the slider body 110. Particularly, as shown in FIG. 3B, in the state where the second shaft portion 134 lifts the claw member 120, the lock pin portion 122 moves upward to a position where its end 122*a* is located at a higher position than the inner surface of the upper wing plate 111 of the slider body 110, thereby causing the end 122*a* of the lock pin portion 122 to leave the space between the upper wing plate 111 and the lower wing plate 112 and thus releasing the locked state.

Moreover, in this embodiment, since the claw member 120 is, for instance, a leaf spring and is secured to the slider body 110 through the fixed end portion 124, while the front end portion P1 of the operation piece 130 rotates around the first shaft portion 132 as the axis center and allows the second shaft portion 134 to lift the claw member 120, the claw member 120 deforms and accumulates an elastic restoration force due to its flexibility. When the operation on the operation piece 130 is stopped, the claw member 120 lifted by the second shaft portion 134 of the operation piece 130 releases the elastic restoration force and is restored in a direction approaching the slider body 110 (i.e., in a downward direction), so that the lock pin portion 122 of the claw member 120 can again extend to the interior of the slider body 110 through the lock through hole 116 of the slider body 110. As such, the lock pin portion 122 of the claw member 120 can easily extend to the interior of the slider body 110 to establish the locked state, facilitating the operation of the slider 100. However, in other embodiments not depicted in the drawings, the claw member 120 may penetrate the second shaft portion 134, or the top and bottom positions of the claw member 120 may be limited by the limiting structure on the operation piece 130. This allows the lock pin portion 122 of the claw member 120 to be restored to the slider body 110 through the reverse operation of the operation piece 130, thereby re-establishing the locked state without being subject to the elastic restoration force of the claw member 120 The method of restoring and locking the lock pin portion 122 after releasing the locked state should not be construed as a limitation in the disclosure and can be adjusted according to actual needs.

As such, in this embodiment, the slider 100 can release the locked state of the lock pin portion 122 through simple operation of the operation piece 130 (e.g., gently pressing the operation portion 136 of the operation piece 130) based on the principle of leverage. Moreover, there is no need to position any tab pull for the user to pull to release the lock pin portion 122, and the first shaft portion 132 and the second shaft portion 134 are separately positioned, which can reduce the overall volume of the slider 100. Especially, compared to a general tab pull, the operation piece 130 does not need to move the entire slider 100 and can be simply configured to be pressed, thereby reducing the size. The overall thickness of the slider 100 is relatively small and adapted to be applied on the slide fastener installed in the hoods of clothes. As such, when the slider 100 is not in use, it is not interfered by the tab pull (e.g., not affected by the swinging of the tab pull or the overall large volume). Moreover, since the operation portion 136 of the operation piece 130 is positioned at the front end portion P1 and corresponds to the front end E1 of the slider body 110, pressing the operation piece 130 from the front end E1 of the slider body 110 to lift the claw member 120 is with ease. Accordingly, the slider 100 is operable in a simple operation manner and can reduce the overall volume. However, the specific structure of the operation piece 130 (for instance, the position of the operation portion 136 and whether the finger gripping portion 138 is positioned or not should not be construed as limitations in the disclosure) and the specific operation manner of lifting the claw member 120 by the operation piece 130 should not be construed as limitations in the disclosure and can be adjusted according to actual needs.

To be specific, in this embodiment, as shown in FIG. 2 and FIG. 3A, the first shaft portion 132 of the operation piece 130 is, for instance, a pair of protruding columns extending outward in a width direction (i.e., a left-right direction in FIG. 2) along a first axis direction A1. Correspondingly, the upper surface of the upper wing plate 111 of the slider body 110 is equipped with a pair of grooves 118 that are open inward for the insertion of the pair of protruding columns of the first shaft portion 132 (only one side is shown in FIG. 2). As such, by inserting the pair of protruding columns of the first shaft portion 132 into the pair of grooves 118, the operation piece 130 may be rotatably positioned on the slider body 110 through the first shaft portion 132. In an embodiment of the disclosure, the slider body 110 has a limiting portion 119 for limiting the first shaft portion 132 of the operation piece 130, and the limiting portion 119 is located closer to the front end E1 of the slider body 110 than the first shaft portion 132. The limiting portion 119 is, for instance, positioned on the upper surface of the upper wing plate 111 and is a pair of protrusions located in front of the pair of grooves 118. As such, the limiting portion 119 may limit the movement of the first shaft portion 132 from the front side (i.e., the side corresponding to the front end E1) to prevent the first shaft portion 132 from falling out of the grooves 118. Moreover, the arrangement of the structure with the relatively small volume on the first shaft portion 132 contributes to the reduction of the volume of the slider body 110 and the operation piece 130. However, the specific implementation manner of the first shaft portion 132 and the structure located on the slider body 110 and to be installed to the first shaft portion 132 should not be construed as limitations in the disclosure and can be adjusted according to actual needs.

For instance, in the variant embodiment shown in FIG. 4 and FIG. 5, the main structure of a slider 100A is similar to the slider 100 described earlier, while the primary difference lies in that a first shaft portion 132A of an operation piece 130A and the structure located on a slider body 110A and to be installed to the first shaft portion 132A are different from those provided above (other similarities are not repeatedly described). Specifically, in this variant embodiment, the first shaft portion 132A of the operation piece 130A is, for instance, a pair of protruding columns extending inward in the width direction (i.e., the left-right direction in FIG. 5) along the first axis direction A1. Correspondingly, an upper surface of an upper wing plate 111A of the slider body 110A is equipped with a pair of grooves 118A that are open outward for the insertion of the pair of protruding columns serving as the first shaft portion 132A (only one side is shown in FIG. 5). As such, by inserting the pair of protruding columns serving as the first shaft portion 132A into the pair of grooves 118A, the operation piece 130A may be rotatably positioned on the slider body 110A through the first shaft portion 132A. Similarly, in this variant embodiment, a pair of protrusions in front of the pair of grooves 118A may also be positioned on the upper surface of the upper wing plate 111A of the slider body 110A, and the pair of protrusions may serve as a limiting portion 119A for limiting the first shaft portion 132A of the operation piece 130A (which should however not be construed as a limitation).

It can be accordingly learned that not only the first shaft portion 132 of the operation piece 130 of the slider 100 in this embodiment but also the first shaft portion 132A of the operation piece 130A of the slider 100A in the variant embodiment is applicable. Thus, in other embodiments not depicted in the drawings, the first shaft portion 132 of the operation piece 130 of the slider 100 may also be a connection rod extending along the first axial direction A1, and the upper surface of the upper wing plate 111 of the slider body 110 may be equipped with a slot that is open upward for the insertion of the connection rod of the first shaft portion 132. As long as the first shaft portion 132 can serve as the axis center of the operation piece 130 and allow the operation piece 130 to rotate relative to the slider body 110, the specific structure of the first shaft portion 132 of the operation piece 130 and the structure located on the slider body 110 and to be installed to the first shaft portion 132 should not be construed as limitations in the disclosure and can be adjusted according to actual needs.

Moreover, in this embodiment, as shown in FIG. 2 and FIG. 3A, the second shaft portion 134 of the operation piece 130 is, for instance, a connection rod extending along a second axial direction A2. Correspondingly, the hanging portion 126 of the claw member 120 is hung on the connection rod serving as the second shaft portion 134, which allows the operation piece 130 to connect the claw member 120 through the second shaft portion 134. However, in other embodiments not depicted in the drawings, the second shaft portion 134 may also be one or a pair of protruding columns extending inward in the width direction (i.e., the left-right direction in FIG. 2) along the second axial direction A2. Alternatively, the second shaft portion 134 may also have a slot for the insertion of the claw member 120. As long as the second shaft portion 134 can lift the claw member 120 upwards when the operation piece 130 rotates relative to the slider body 110 with the first shaft portion 132 as the axis center, the specific structure of the second shaft portion 134 is not construed as a limitation in the disclosure and can be adjusted according to actual needs.

In this embodiment, as shown in FIG. 2, an insertion portion 139 for the insertion of the claw member 120 is positioned at a center of the operation piece 130. The insertion portion 139 is, for instance, an opening formed between the operation portion 136 and the second shaft portion 134 and thus positioned between the front end portion P1 and the rear end portion P2. As such, the fixed end portion 124 of the claw member 120, which is located closer to the front side (i.e., the side corresponding to the front end portion P1) than the second shaft portion 134, is secured to the interior of the slider body 110 through the insertion portion 139, which can avoid the interference caused by the positioning of the claw member 120 with the operation of the operation piece 130 (i.e., the rotation relative to the slider body 110 with the first shaft portion 132 as the axis center). Moreover, in an embodiment of the disclosure, the first axial direction A1 of the first shaft portion 132 is perpendicular to a centerline C of the claw member 120 (as shown in FIG. 1). As such, the rotation of the operation piece 130 with the first shaft portion 132 as the axis center easily allows the claw member 120 to be lifted along the centerline C. That is, a force generated by the operation piece 130 based on the principle of leverage can be effectively applied to the claw member 120 along the centerline C to lift the claw member 120. Correspondingly, the first axial direction A1 and the second axial direction A2 are parallel to each other, so that the first shaft portion 132 and the second shaft portion 134 are parallel to each other. However, in other embodiments not depicted in the drawings, the first axial direction A1 and the second axial direction A2 may also be not parallel to each other. The extension axis directions of the first shaft portion 132 and the second shaft portion 134 are not construed as limitations in the disclosure. In particular, as long as the second shaft portion 134 can be used to lift the claw member 120, the invention is not limited to what is described in the disclosure.

Besides, in this embodiment, as shown in FIG. 3A, in the locked state, a first distance H1 in a height direction of the slider body 110 (i.e., an up-down direction in FIG. 3A) exists between the end 122*a* of the lock pin portion 122 extending to the interior of the slider body 110 and the inner surface of the upper wing plate 111. A second distance H2 in the height direction exists between an axis center (i.e., the first axial direction A1) of the first shaft portion 132 and an axis center (i.e., the second axial direction A2) of the second shaft portion 134, and the second distance H2 is less than the first distance H1. In other words, the first shaft portion 132 and the second shaft portion 134 are spaced apart from each other by a distance in a front-rear direction of the operation piece 130 (i.e., the left-right direction in FIG. 3A), providing a length between the axis center of the first shaft portion 132 and the axis center of the second shaft portion 134 for executing the principle of leverage, so as to shorten the distance in the height direction of the operation piece 130 between the first shaft portion 132 and the second shaft portion 134. As such, the operation piece 130 may be arranged to have a reduced thickness (i.e., reducing the volume in the height direction), thereby reducing the overall volume of the slider 100. Moreover, switching between the locked state (i.e., the state in FIG. 3A) and the released state (i.e., the state in FIG. 3B) by operating (e.g., pressing) the operation piece 130 may be performed with ease. However, the relative positions of the first shaft portion 132 and the second shaft portion 134 should not be construed as limitations in the disclosure and can be adjusted according to actual needs.

Additionally, in this embodiment, as shown in FIG. 3A and FIG. 3B, the operation piece 130 has a protruding portion P3 located between the front end portion P1 and the rear end portion P2 and protruding upward or downward (the protruding portion P3 protrudes downward as exemplarily shown in FIG. 3A and FIG. 3B), and the first shaft portion 132 is positioned at the protruding portion P3. As a comparative illustration, in the case where the operation piece is shaped as a flat sheet (not shown), in order to execute the principle of leverage, it may be necessary to lower the upper surface of the upper wing plate 111, and at the same time, in order to ensure the strength of the slider body 110, it may be necessary to increase the overall thickness of the slider body 110. By contrast, as shown in FIG. 3A and FIG. 3B, setting a protruding portion P3 that protrudes downward on the operation piece 130 creates a height difference between the front end portion P1 of the operation piece 130 and the upper surface of the upper wing plate 111, so as to facilitate the operation of the front end portion P1 based on the principle of leverage in no need of lowering the upper surface of the upper wing plate 111 or increasing the overall thickness of the slider body 110. As such, it is possible to reduce the thickness of the operation piece 130 and reduce the overall thickness of the slider body 110.

Moreover, in this embodiment, the first shaft portion 132 is positioned at the protruding portion P3 protruding downward, and there is a height difference (i.e., the second distance H2) in the height direction (i.e., the up-down direction in FIG. 3A) between the axis center (i.e., the first axial direction A1) of the first shaft portion 132 and the axis center (i.e., the second axial direction A2) of the second shaft portion 134, thus ensuring the length between the axis center of the first shaft portion 132 and the axis center of the second shaft portion 134 for executing the principle of leverage. Accordingly, the distance between the first shaft portion 132 and the second shaft portion 134 in the front-rear direction of the operation piece 130 (i.e., the left-right direction in FIG. 3A) may be shortened. As such, the length of the operation piece 130 and the thickness of the slider body 110 may be reduced, thereby reducing the overall volume of the slider 100. However, whether the protruding portion P3 protruding downward is positioned on the operation piece 130 should not be construed as a limitation in the disclosure.

For instance, in the variant embodiment shown in FIG. 6, the main structure of a slider 100B is similar to the slider 100 described earlier, while the primary difference lies in that an operation piece 130B has a protruding portion P3 located between the front end portion P1 and the rear end portion P2 and protruding upward, and a first shaft portion 132B is positioned at the protruding portion P3 that protrudes upward. As such, a second distance H2' in the height direction (i.e., the up-down direction in FIG. 6) between the axis center (i.e., the first axial direction A1) of the first shaft portion 132B and the axis center (i.e., the second axial direction A2) of the second shaft portion 134 increases, thus providing a length between the axis center of the first shaft portion 132B and the axis center of the second shaft portion 134 for executing the principle of leverage and accordingly shortening the distance between the first shaft portion 132B and the second shaft portion 134 in the front-rear direction of the operation piece 130 (i.e., the left-right direction in FIG. 3A). As a result, the length of the operation piece 130B and the thickness of the slider body 110B can be reduced, thereby reducing the overall volume of the slider 100B. Moreover, the claw member 120 can be easily lifted based on the principle of leverage. It can be learned from the above that as long as the first shaft portion 132 can serve as the axis center of the operation piece 130 and allow one side of the operation piece 130 to rotate relative to the slider body 110, and the second shaft portion 134 can be configured to lift the claw member 120, a protruding direction of the protruding portion P3, whether the protruding portion P3 is positioned or not, and the relative positions of the first shaft portion 132 and the second shaft portion 134 of the operation piece 130 should not be construed as limitations in the disclosure and can be adjusted according to actual needs.

To sum up, in the slider provided in one or more embodiments of the disclosure, the claw member has the lock pin portion that extends to the interior of the slider body to establish the locked state, and the operation piece has the first shaft portion and the second shaft portion that are separately positioned. The operation piece is rotatably positioned on the slider body through the first shaft portion and is connected to the claw member through the second shaft portion. When the operation piece is pressed to enable one side of the operation piece to rotate toward the slider body with the first shaft portion as the axis center, the operation piece lifts the claw member through the second shaft portion to release the locked state of the lock pin portion in the interior of the slider body. In an embodiment of the disclosure, the operation piece has the front end portion and the rear end portion, the front end portion is equipped with the operation portion configured to release the locked state, the second shaft portion is positioned on the rear end portion, and the first shaft portion is positioned at a location closer to the front end portion than the second shaft portion, so as to easily lift the claw member from the front end side. As such, the slider can release the locked state of the lock pin portion through simple operation of the operation piece (for instance, gently pressing the operation piece) based on the principle of leverage. Moreover, it is not necessary to position any tab pull for the user to pull to release the lock pin portion, and the first shaft portion and the second shaft portion are separately positioned, which can reduce the overall volume of the slider. Accordingly, the slider provided in one or more embodiments of the disclosure is operable in a simple operation manner and capable of reducing the overall volume.

Although the disclosure has been described above through embodiments, the embodiments do not serve to pose any limitation in the disclosure. Those with ordinary knowledge in the pertinent technical field are able to make some modifications to the disclosed embodiments without departing from the spirit and scope of the disclosure, and therefore the protection scope provided in the disclosure shall be determined by the following claims and their equivalents.

What is claimed is:

1. A slider, comprising:

a slider body (110, 110A, 110B);

a claw member (120), positioned on the slider body (110, 110A, 110B) and having a lock pin portion (122) extending to an interior of the slider body (110, 110A, 110B) to establish a locked state; and an operation piece (130, 130A, 130B), positioned on the slider body (110, 110A, 110B) and connected to the claw member (120), wherein the operation piece (130, 130A, 130B) has a first shaft portion (132, 132A, 132B) and a second shaft portion (134) which are separately positioned, the operation piece (130, 130A, 130B) is rotatably positioned on the slider body (110, 110A, 110B) through the first shaft portion (132, 132A, 132B) and is connected to the claw member (120) through the second shaft portion (134), and when the operation piece (130, 130A, 130B) is pressed to enable one side of the operation piece (130, 130A, 130B) to rotate toward the slider body (110, 110A, 110B) with the first shaft portion (132, 132A, 132B) as an axis center, the operation piece (130, 130A, 130B) lifts the claw member (120) through the second shaft portion (134) to release the locked state of the lock pin portion (122) in the interior of the slider body (110, 110A, 110B).

2. The slider according to claim 1, wherein the operation piece (130, 130A, 130B) has a front end portion (P1) corresponding to a front end (E1) of the slider body (110, 110A, 110B) and a rear end portion (P2) corresponding to a rear end (E2) of the slider body (110, 110A, 110B), the front end portion (P1) is equipped with an operation portion (136) configured to release the locked state, the second shaft portion (134) is positioned on the rear end portion (P2), and the first shaft portion (132, 132A, 132B) is positioned at a location closer to the front end portion (P1) than the second shaft portion (134).

3. The slider according to claim 2, wherein the front end portion (P1) of the operation piece (130, 130A, 130B) is equipped with a finger gripping portion (138).

4. The slider according to claim 2, wherein the operation piece (130B) has a protruding portion (P3) located between the front end portion (P1) and the rear end portion (P2) and protruding upwards or downwards, and the first shaft portion (132B) is positioned at the protruding portion (P3).

5. The slider according to claim 2, wherein the operation portion (136) of the operation piece (130, 130A, 130B) is shaped as a rectangle in a width direction of the slider body (110, 110A, 110B).

6. The slider according to claim 1, wherein the claw member (120) has a fixed end portion (124) extending to a front end (E1) of the slider body (110, 110A, 110B), and the fixed end portion (124) is secured at a location lower than an upper wing plate (111) of the slider body (110, 110A, 110B).

7. The slider according to claim 1, wherein a center of the operation piece (130, 130A, 130B) is equipped with an insertion portion (139) configured to be inserted by the claw member (120).

8. The slider according to claim 1, wherein the slider body (110, 110A) has a limiting portion (119, 119A) configured to restrict the first shaft portion (132, 132A) of the operation piece (130, 130A, 130B), and the limiting portion (119, 119A) is located closer to a front end (E1) of the slider body (110, 110A, 110B) than the first shaft portion (132, 132A).

9. The slider according to claim 1, wherein in the locked state, a first distance (H1) in a height direction of the slider body (110, 110A) exists between an end (122*a*) of the lock pin portion (122) extending to the interior of the slider body (110, 110A) and an inner surface of an upper wing plate (111) of the slider body (110, 110A), a second distance (H2) in the height direction exists between an axis center of the first shaft portion (132, 132A) and an axis center of the second shaft portion (134), and the second distance (H2) is less than the first distance (H1).

10. The slider according to claim 1, wherein the claw member (120) is a flexible leaf spring.

* * * * *